US006000754A

United States Patent [19]

Lawson

[11] Patent Number: 6,000,754

[45] Date of Patent: Dec. 14, 1999

[54] ROCKER ASSEMBLY FOR ROCKER-RECLINER CHAIRS

[75] Inventor: Gregory M. Lawson, Tupelo, Miss.

[73] Assignee: Omega Motion LLC, Saltillo, Miss.

[21] Appl. No.: 09/003,236

[22] Filed: Jan. 6, 1998

Related U.S. Application Data

[60] Provisional application No. 60/034,228, Jan. 6, 1997.

[51] Int. Cl.[6] ..... A47C 3/02

[52] U.S. Cl. ..... 297/259.2; 297/85; 297/265.1; 297/270.1; 297/DIG. 7

[58] Field of Search ..... 297/259.1, 258.1, 297/68, 264.1, 265.1, 266.1, 267.1, 270.1, 259.2, 85, DIG. 7, 259.4

[56] References Cited

U.S. PATENT DOCUMENTS

| | | |
|---|---|---|
| 3,464,736 | 9/1969 | Mizelle . |
| 3,767,257 | 10/1973 | Rogers, Jr. et al. . |
| 3,802,735 | 4/1974 | Re . |
| 4,057,289 | 11/1977 | Jones . |
| 4,071,276 | 1/1978 | Cecil . |
| 4,519,647 | 5/1985 | Rogers, Jr. . |
| 4,707,025 | 11/1987 | Rogers, Jr. . |
| 5,370,442 | 12/1994 | Saul et al. . |

OTHER PUBLICATIONS

Drawings of prior rocker recliner mechanism of Super Sagless Corp. that is prior art. The drawings were prepared by the inventor in the subject application. (Sheets A & B). Drawings of rocker recliner mechanism of present application (Sheets C & D).

*Primary Examiner*—Milton Nelson, Jr.
*Attorney, Agent, or Firm*—Wolf, Greenfield & Sacks, P.C.

[57] ABSTRACT

A rocker-recliner chair comprising a base for standing on the floor and having a pair of side rails, rocker cams seated for rocking motion backward and forward on the side rails, a cross tube assembly disposed above the base and having side plates and cross tubes, a reclining linkage mechanism having a pair of base plates adjustably connected to the cams for backward and forward adjustment with respect to the cams, adjustable connections joining the cross tube assembly to each base plate of the mechanism for enabling the cross tube assembly to be moved forward and backward with respect to the mechanism, a chair frame having a seat, backrest and footrest carried by the mechanism and movable between upright and reclined positions with respect to the base, and a stabilizing spring assembly connected between the cross rail assembly and the base for biasing the rocker cam, linkage mechanism and chair frame to an upright position on the base.

15 Claims, 12 Drawing Sheets

ROCKER ASSEMBLY FOR ROCKER-RECLINER CHAIRS

This application claims the benefit of prior filed Provisional Application No. 60/034,228 filed Jan. 6, 1997 entitled "CAM, MECHANISM AND BASE ASSEMBLY FOR ROCKER RECLINER."

FIELD OF THE INVENTION

This invention relates to rocker-recliners and more particularly comprises a new and improved rocker assembly that enables the chair to rock to and fro on a base resting on the floor.

BACKGROUND OF THE INVENTION

Rocker-recliners conventionally employ rocker cams having curved lower surfaces that rest on a fixed base and in turn carry the reclining mechanism which supports the seat, back rest and foot rest of the chair. A rocker blocking assembly connected to the reclining mechanism and the base prevents the cams from rocking on the fixed base when the chair is moved from the upright to a reclining position. When the rocker blocking assembly is inactive (when the chair is in the upright position), the rocking motion is controlled by spring assemblies conventionally connected between the rocker cams and the base. The various connections between the mechanisms, cams, spring assemblies and base are not susceptible to convenient adjustment to compensate for differences in the center of gravity of the chair caused by different chair styles, e.g., chairs with heavy or lightweight backs and deep or short seats, and by different body sizes of the people occupying the chair. Typical examples of prior art rocker-recliners are shown in the U.S. Pat. Nos. 3,537,747, 3,730,585 and 4,519,647.

One important object of the present invention is to provide an improved rocker-recliner that enables the spring assemblies to be adjusted forward and backward independently of the reclining mechanism and rocker cams.

Another important object of the present invention is to provide a rocker-recliner that enables the rocker cams to be adjusted forward and backward independently of the reclining mechanism and spring assemblies.

Yet another object of the present invention is to provide a method of connecting the various components of a rocker-recliner together in a fashion that is suitable for use with either a metal or wood base and wood, plastic or metal rocker cams.

Another object of the present invention is to provide a spring assembly which maintains the preload applied to the springs when the location of the spring assembly is adjusted.

To accomplish these and other objects, in accordance with the present invention, the base plates of the reclining mechanism are adjustably connected to and supported on the upper horizontal surface of the rocker cams so that the cams can be moved forward or backward with respect to the mechanism and the seating components of the chair carried by the mechanism. A cross tube assembly is also adjustably connected between the base plates of the reclining mechanism, and the spring assemblies in turn are connected at their tops to the cross tube assembly. The lower ends of the spring assemblies are connected at a fixed position to the base. With these adjustments, the balance of the chair may easily be changed by moving the cams and/or the spring assemblies with respect to the mechanism.

These and other objects and features of the invention will be better understood and appreciated from the following detailed description of two embodiments thereof read in connection with the accompanying drawings.

BRIEF FIGURE DESCRIPTION

DETAILED DESCRIPTION

Figure 1:
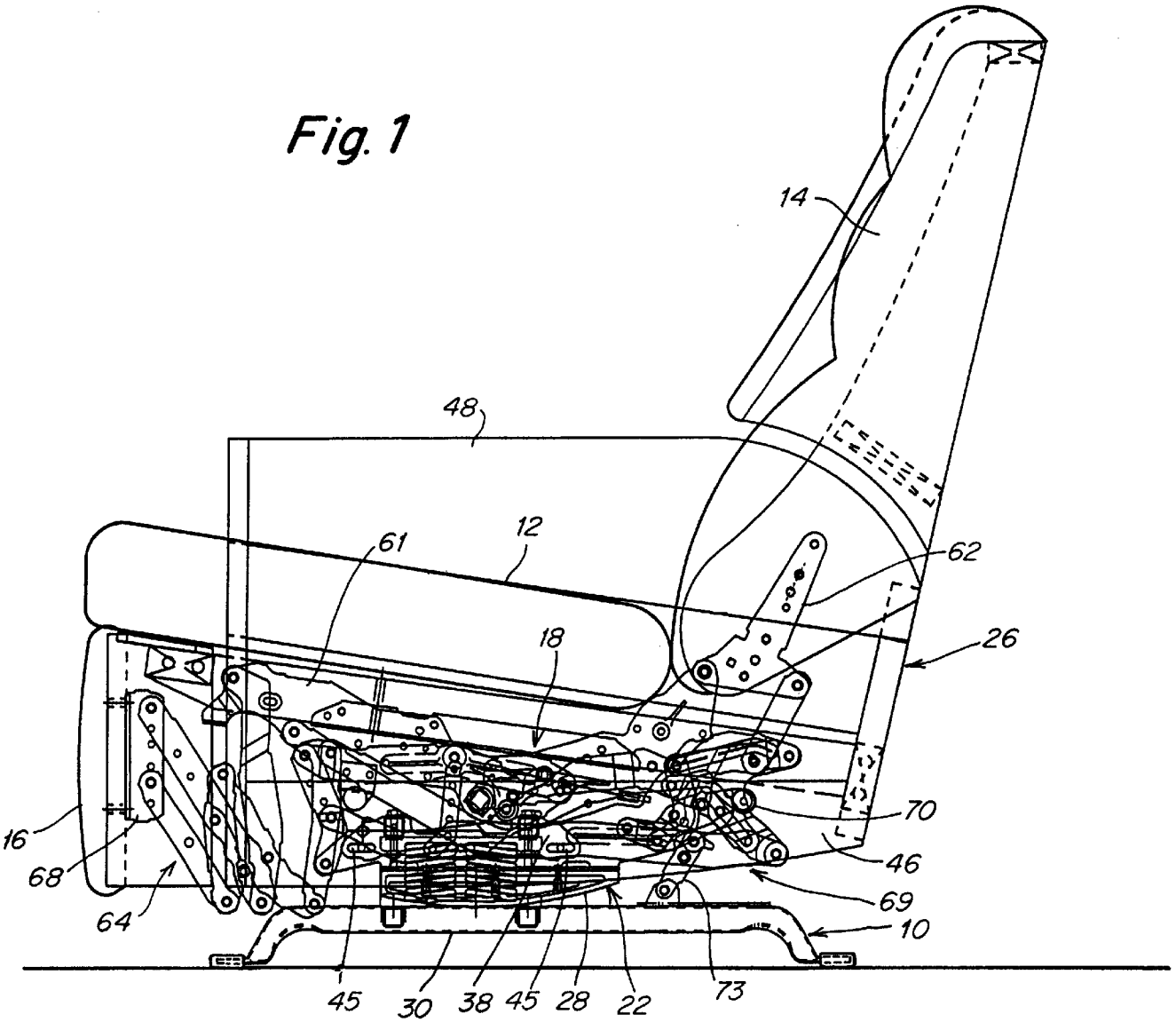
FIG. 1 is a side elevation view of a preferred embodiment of a rocker-recliner with one side of the chair removed, constructed in accordance with the present invention.

The chair illustrated in FIGS. 1–7 embodies the present invention and includes a metal base 10, seat 12, backrest 14, footrest 16, reclining mechanism 18, metal cross-tube assembly 20, rocker cam 22, and spring assembly 24. It should be appreciated that the recliner mechanism 18 and rocker cam 22 are duplicated on each side of the chair. The seat 12 backrest 14 and footrest 16 are all built within or on a wood frame 26. It is apparent in FIG. 1 that the frame 26 and all of the parts enumerated contained in or mounted on it are free to rock back and forth on the base 10 by virtue of the lower curved surface 28 of the rocker cam 22 which rests on the upper surface of the base.

Figure 2:
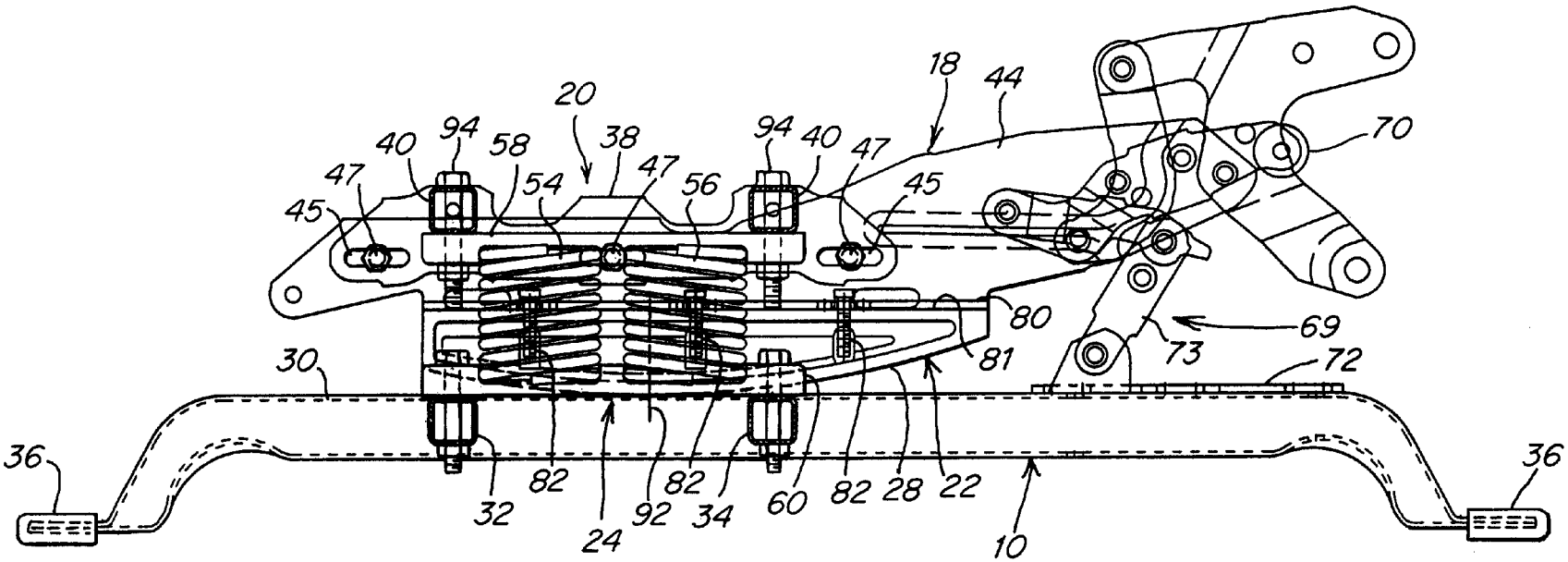
FIG. 2 is an enlarged view of the rocker assembly.
Figure 3:
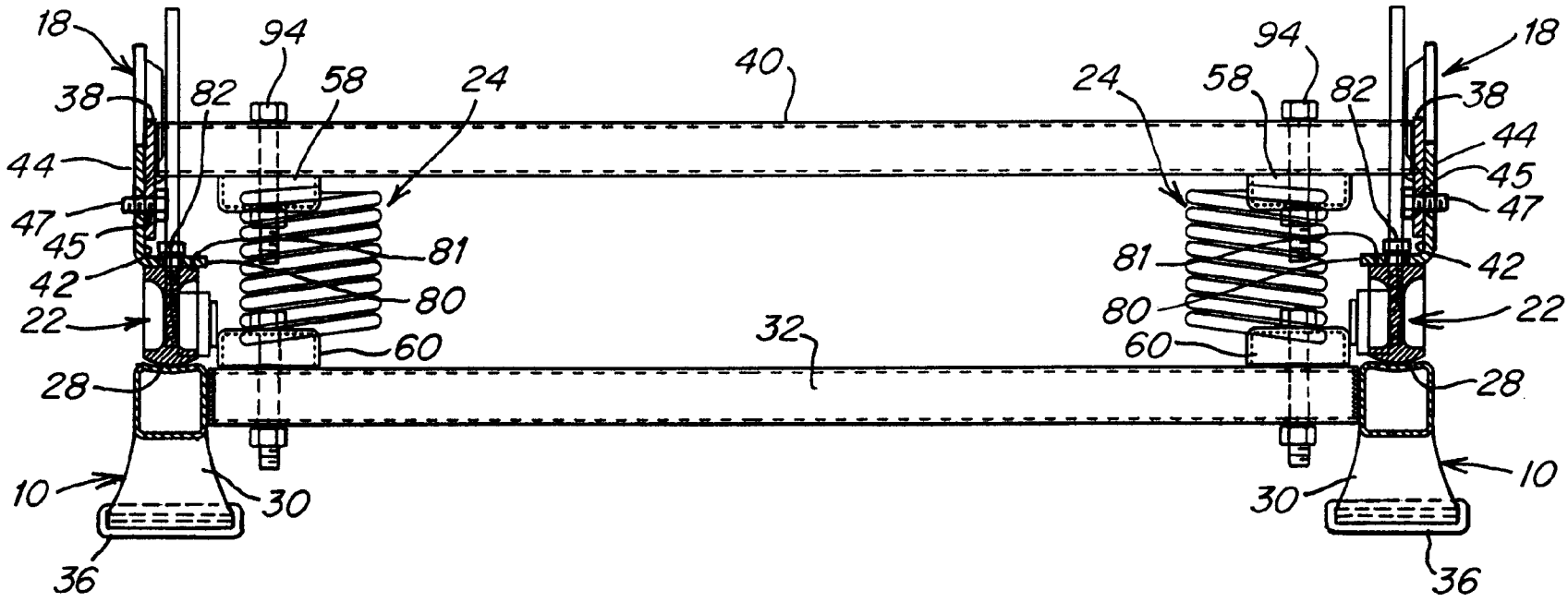
FIG. 3 is a fragmentary front elevation view of the assembly shown in FIG. 2.
Figure 4:
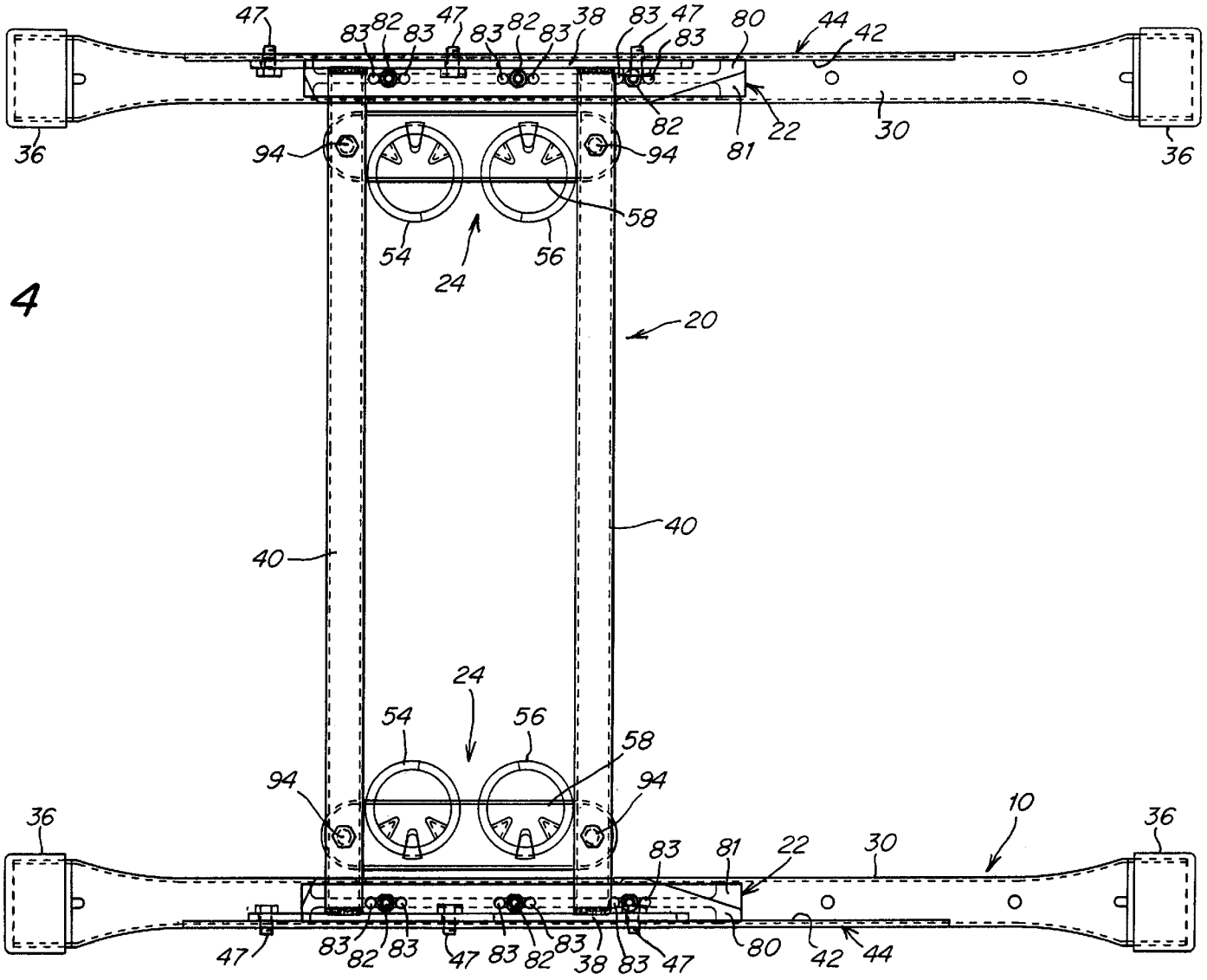
FIG. 4 is a top plan view of the assembly shown in FIGS. 2 and 3.

The base 10 shown in FIGS. 2–4 is made of metal and includes a pair of side rails 30 and tubular metal cross rails 32 and 34 which connect the side rails together. Feet 36 are mounted on the ends of the side rails 30, to protect the floor on which the chair rests.

The metal cross-tube assembly 20 includes a pair of side mounting plates 38 connected together by tubular metal cross tubes 40, square in cross section, and welded to the inner faces of the plates 38. The plates 38 and cross tubes 40 thus form a rectangular assembly essentially equal in width to the width of the base 10 and substantially shorter in a fore and aft direction than the base.

The two mounting plates 38 of the cross-tube assembly 20 are adjustably connected to the inner faces 42 of the base plates 44 of the mechanism 18. The adjustments are made by virtue of the horizontal slots 45 in each mounting plate 38 and the bolts 47 that extend through the base plate and slots. The base plates 44 of the mechanism are also bolted to the side rails 46 which form part of the wood chair frame 26. The side rails 46 lie generally in the planes of the arms 48 of the chair. The slotted connection between the mounting plates 38 of the cross-tube assembly 20 and the base plates 44 of the mechanism enables the cross tube assembly 20 to be shifted forward and backward on the mechanism for reasons that are described in detail below.

The spring assembly 24 (one on each side of the chair) is made up of a pair of coil springs 54 and 56 that are sandwiched between upper and lower plates 58 and 60 respectively connected to the bottoms of tubes 40 of the cross tube assembly 20 and the tops of cross rails 32 and 34. The plates 58 and 60 may be screwed, riveted or otherwise connected to the tubes and rails.

Figure 5:
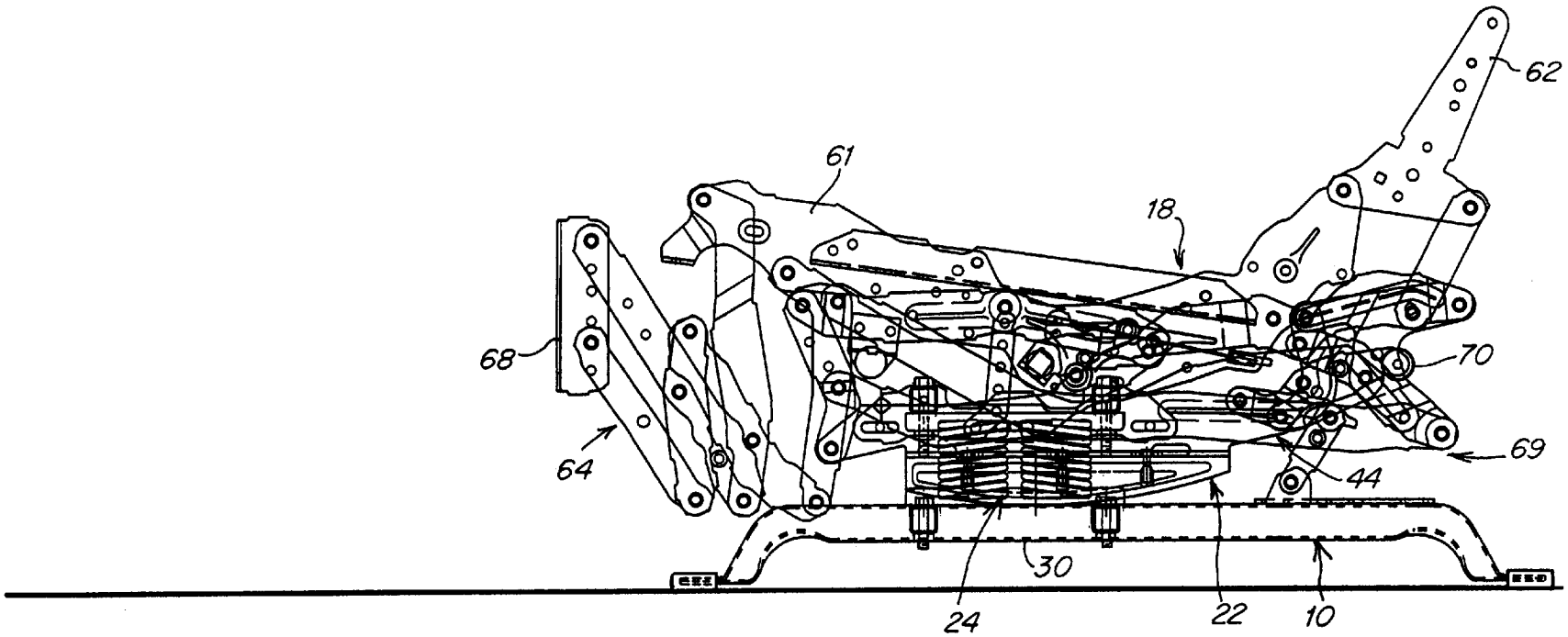
FIG. 5 is a side elevation view similar to FIG. 2 but showing the full recliner mechanism with the chair in the upright position.
Figure 6:
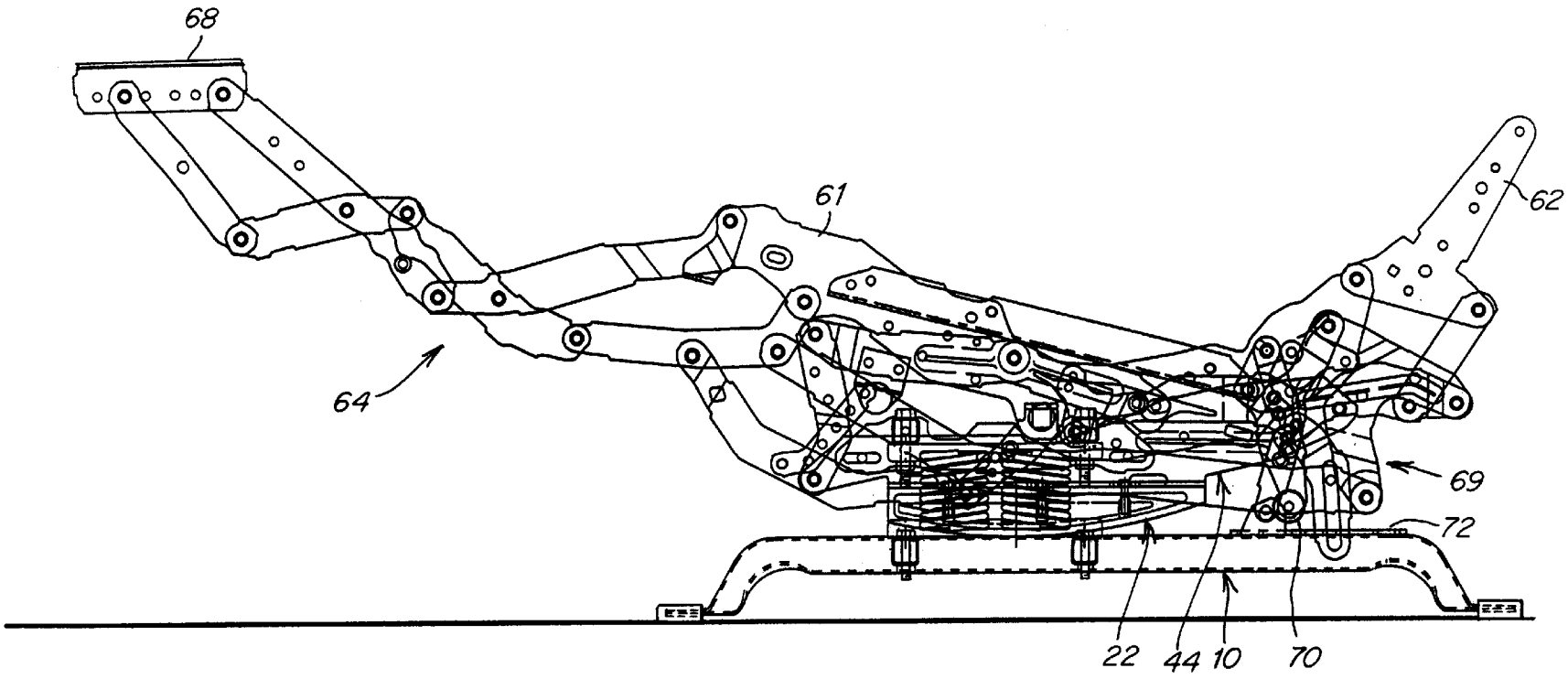
FIG. 6 is a side view similar to FIG. 5 but with the chair mechanism in the intermediate or TV position.
Figure 7:
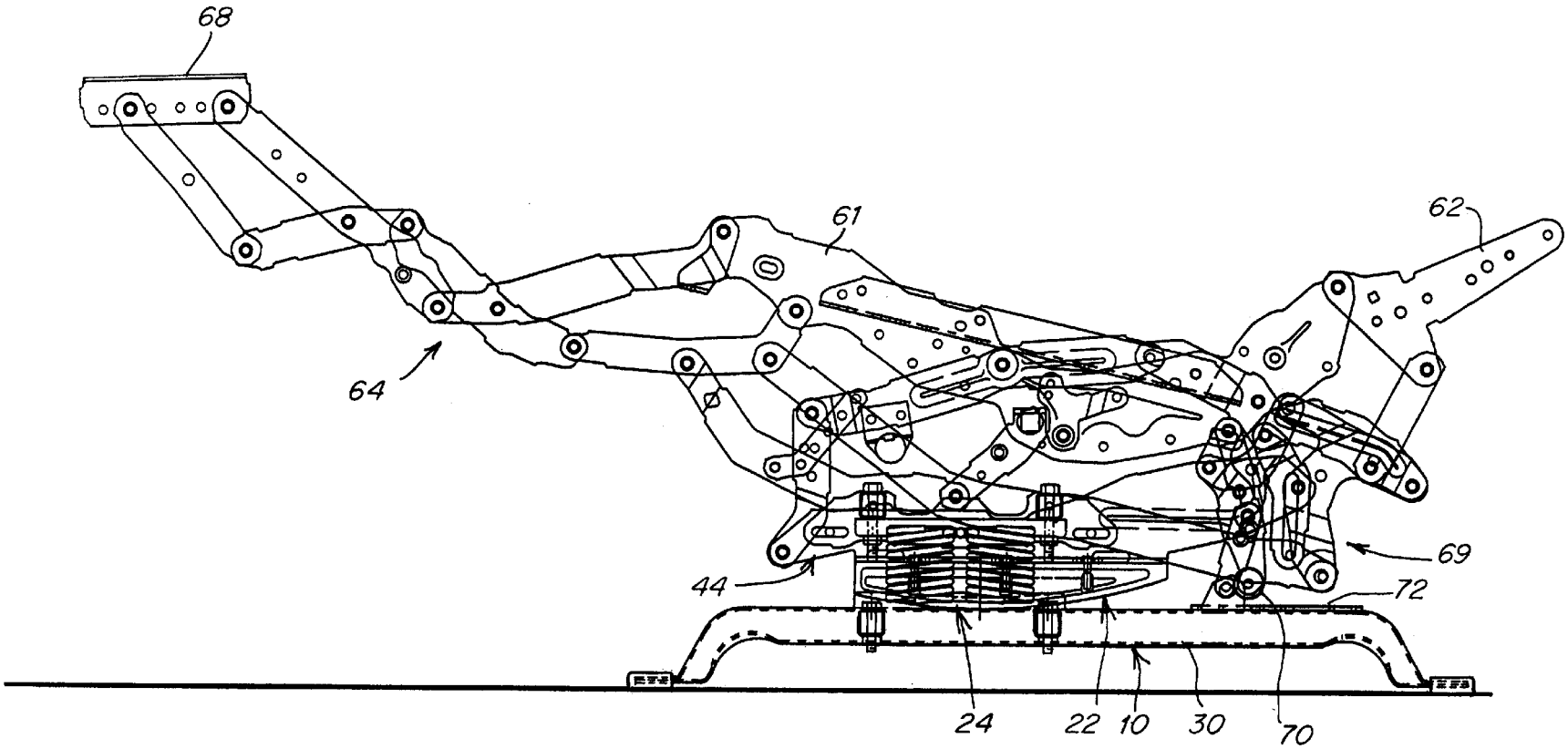
FIG. 7 is a view similar to FIGS. 5 and 6 but with the chair mechanism in the fully reclined position.
Figure 8:
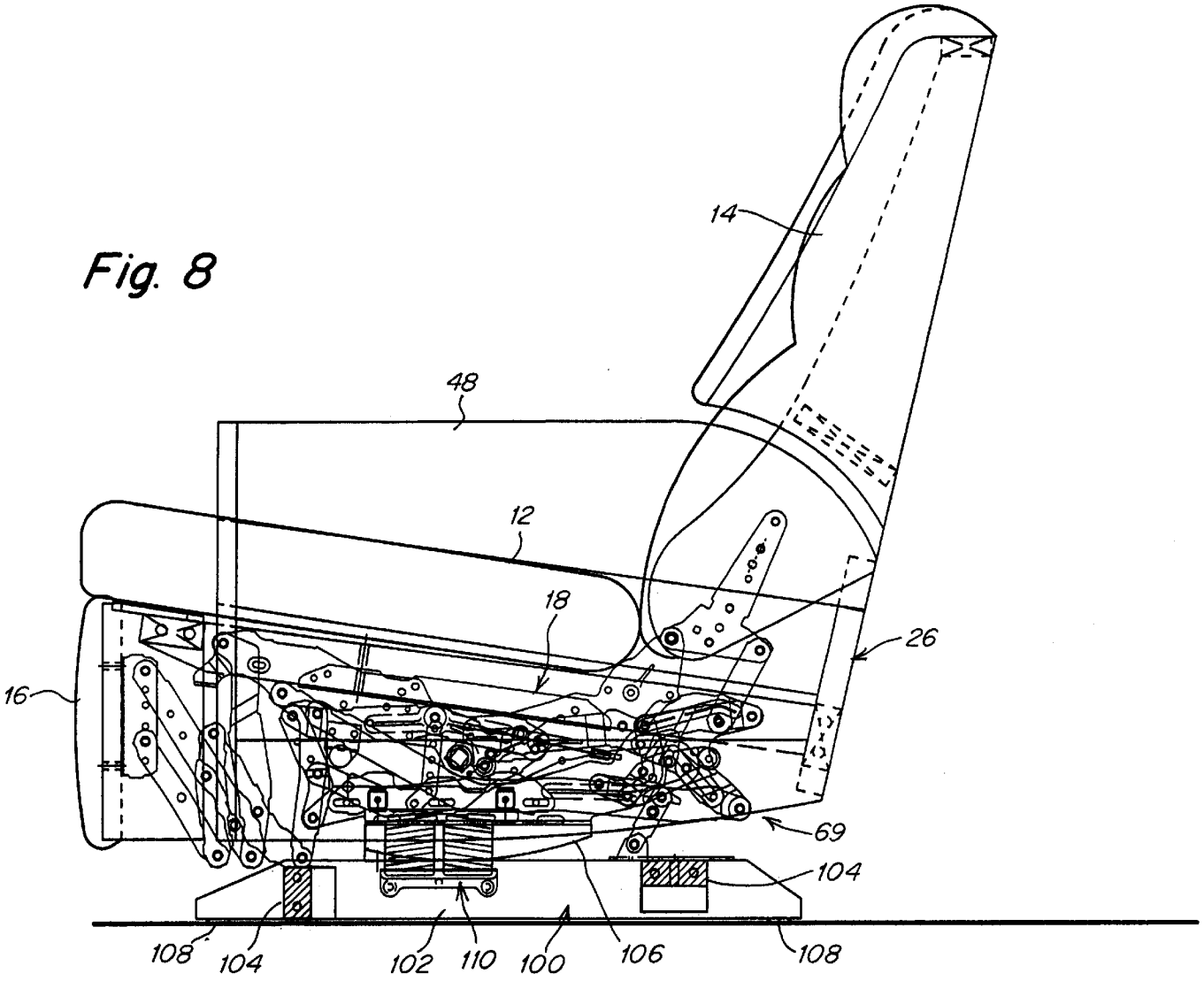
FIG. 8 is a side elevation view similar to FIG. I but showing a second embodiment of the invention.
Figure 9:
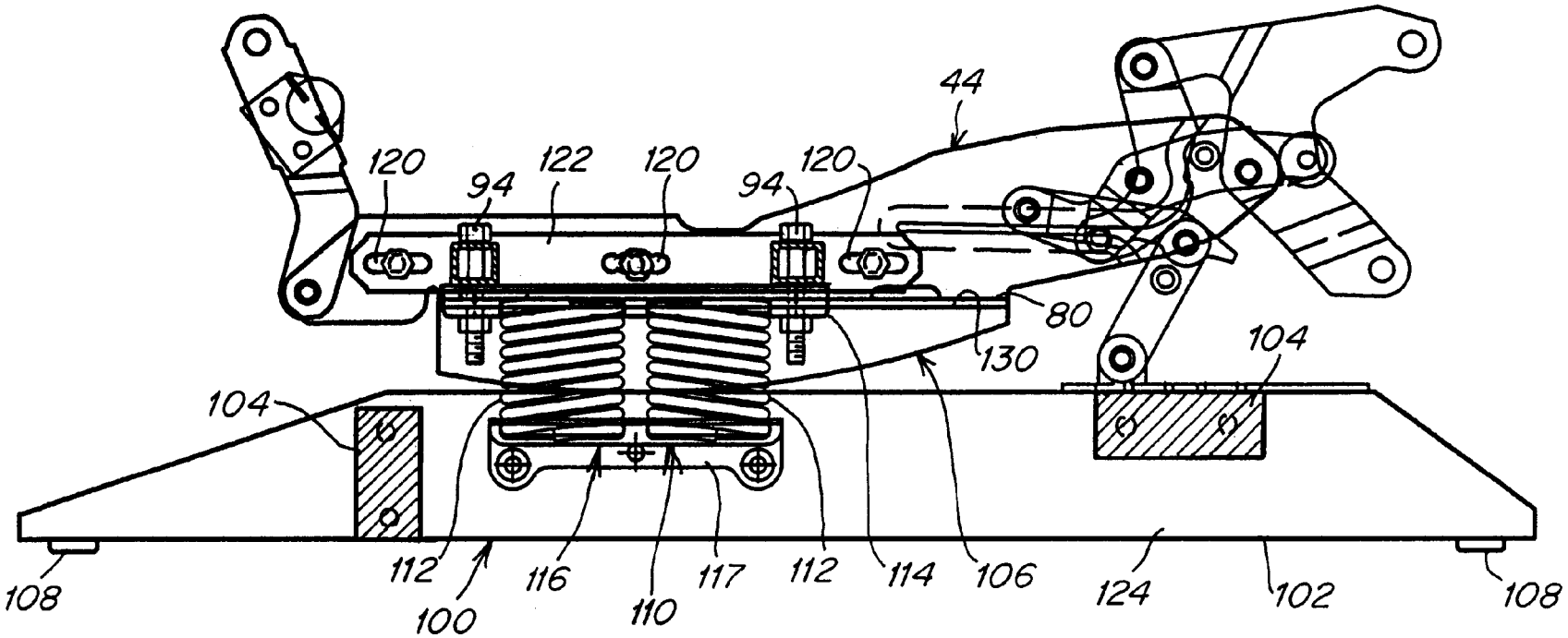
FIGS. 9, 10 and 11 are side, front elevation and top plan views, respectively, of the rocker assembly employed in the chair of FIG. 8.
Figure 10:
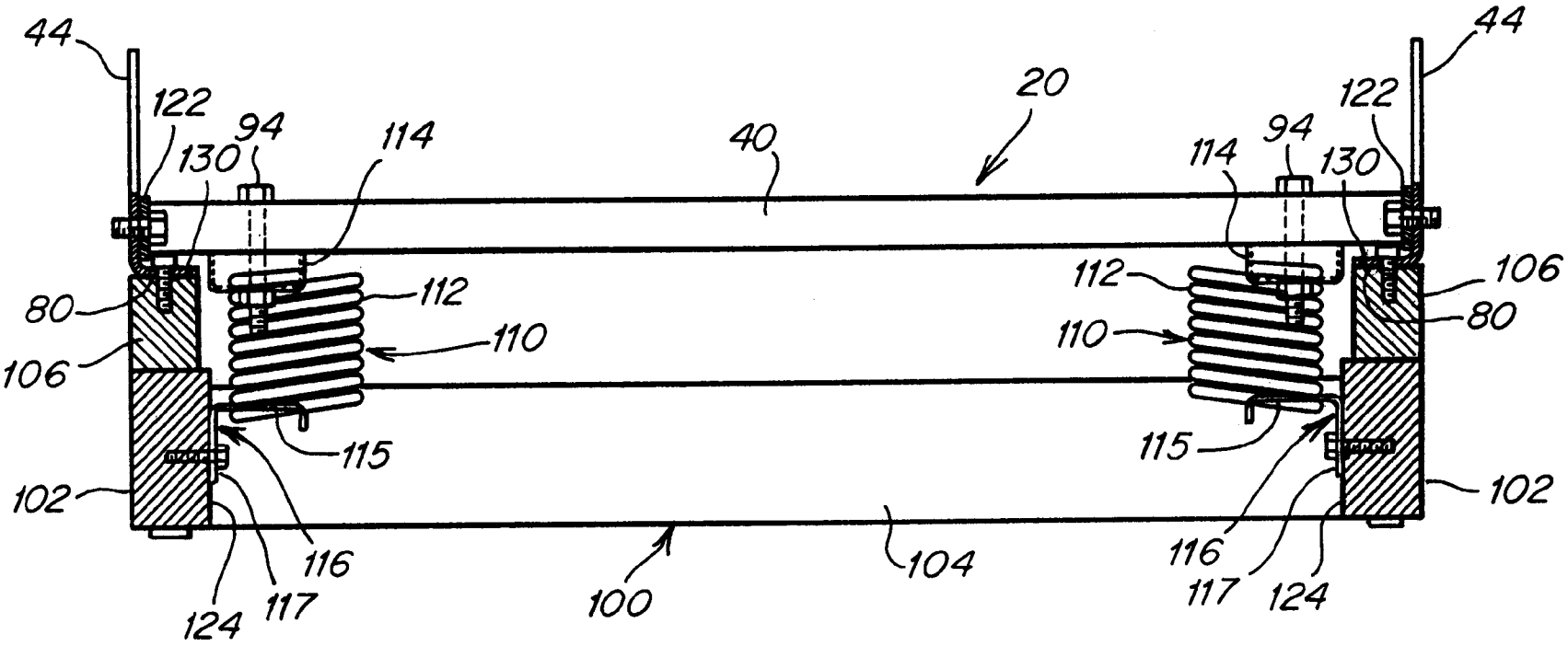
Figure 11:
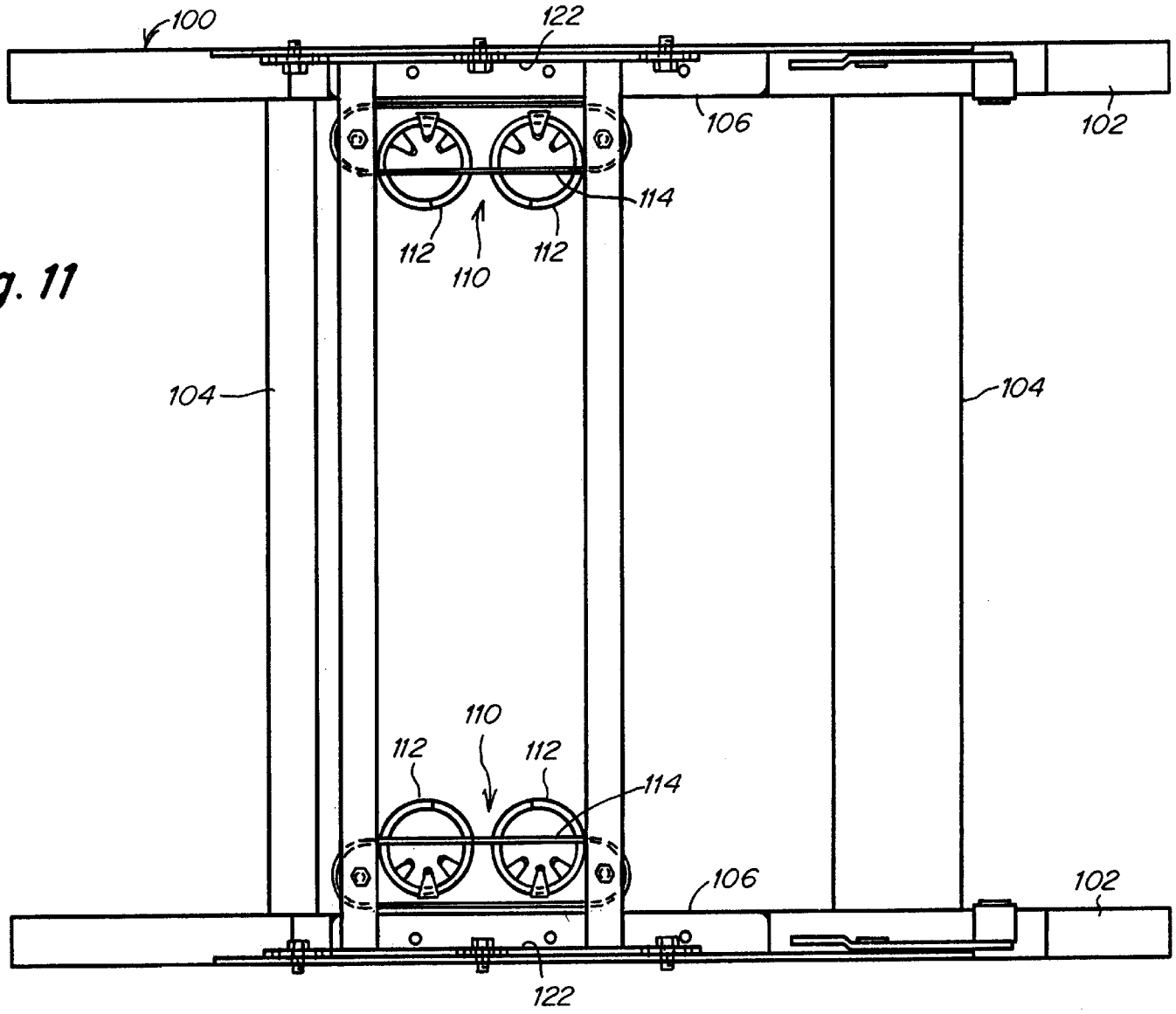

The base plates 44 of the linkage mechanism 18 secured to the side panels 46 of the chair frame 26 support the chair frame and all of the parts of the chair within it, including the seat 12, backrest 14 and footrest 16. The mechanism on each side of the chair includes a seat mounting bracket 61 and a backrest mounting bracket 62 that respectively support the seat 12 and backrest 14. The mechanism further includes a lazy tong linkage 64 that is mounted on the front end of the seat mounting bracket 61. As is clearly shown in FIGS. 5–7, the lazy tong linkage 64 carries a footrest mounting bracket 68 at its free end which in turn carries the cushion of the footrest 16. The type of mechanism shown is well-known in the art and is capable of moving the seat and backrest as a unit in fixed relationship with one another in a forward direction from the upright to TV position as the footrest 16 is extended from the stored position beneath the front of the seat 12. As the chair begins to move to the TV position, a rocker blocker assembly 69 forming part of the linkage mechanism 18 moves to a position wherein its roller 70 engages a metal plate 72 secured to the upper surface of the base side rail 30, which prevents the chair mechanism and everything attached to it from rocking backward on the base while the link 73 prevents forward rocking motion. When the blocker assembly 69 is retracted as shown in FIG. 5, the chair frame 26 along with the seat 12, backrest 14 and retracted footrest 16 are free to rock on the base. The reclining mechanism 18 also permits further reclining motion of the chair as shown in FIG. 7 when pressure is exerted against the backrest. That pressure causes the backrest to pivot in a backward direction while the front of the seat 12 is elevated (compare FIGS. 6 and 7). During that transition, the rocker blocker assembly 69 remains in the operative position to prevent the chair assembly from rocking on the base 10. The present invention is not limited to a rocker-recliner having the specific reclining mechanism illustrated. Other such mechanisms may be used in its place.

In the preferred embodiment shown, the base plate 44 has a lower horizontal flange 80 which is adjustably secured to the upper horizontal surface 81 of the rocker cam 22 by bolts 82, as is most clearly shown in FIGS. 2–4. For that purpose three adjacent holes 83 are provided in the flange 80, which may be selectively used to shift the cam forward or backward with respect to the recliner mechanism. Three holes 82 are shown in FIG. 4 and three alternative holes are provided for each bolt 82. Because the entire load of the chair rests on the upper surfaces of the cams, the cams are essentially subjected only to compressive loads to minimize cam wear. In most prior art constructions, the mechanisms are attached to the sides of the rocker cams, which exert a torque on the cams causing them to wear more along one edge. The adjustability of the cams with respect to the mechanism enables the cams to be selectively positioned so as to accommodate the location of the center of gravity of the chair, independent of the springs. Once the correct position of the cams with respect to the mechanism is determined, the mechanism may be attached to the cams through the appropriate holes 83. Slots in the flange may be an appropriate alternative to the series of holes. Once each rocker cam 22 is fixed with respect to the mechanism 18 and the chair frame 26, etc., the center of gravity of the chair is fixed with respect to the cams. To establish the upright position of the chair at an appropriate angle and achieve the desired stiffness for rocking back and forth, it is necessary to adjust the position of the spring assemblies 24 with respect to the neutral axes 92 of the cams 22. That is conveniently accomplished by loosening the bolts 47 and sliding the cross tube assembly 20 forward or backward with respect to the base plate 44, which carries the spring assemblies with it. By moving the spring assemblies 24 further forward with respect to the neutral axes of the cams, rearward rocking of the chair will be made stiffer while forward rocking will be made easier.

Figure 2A:
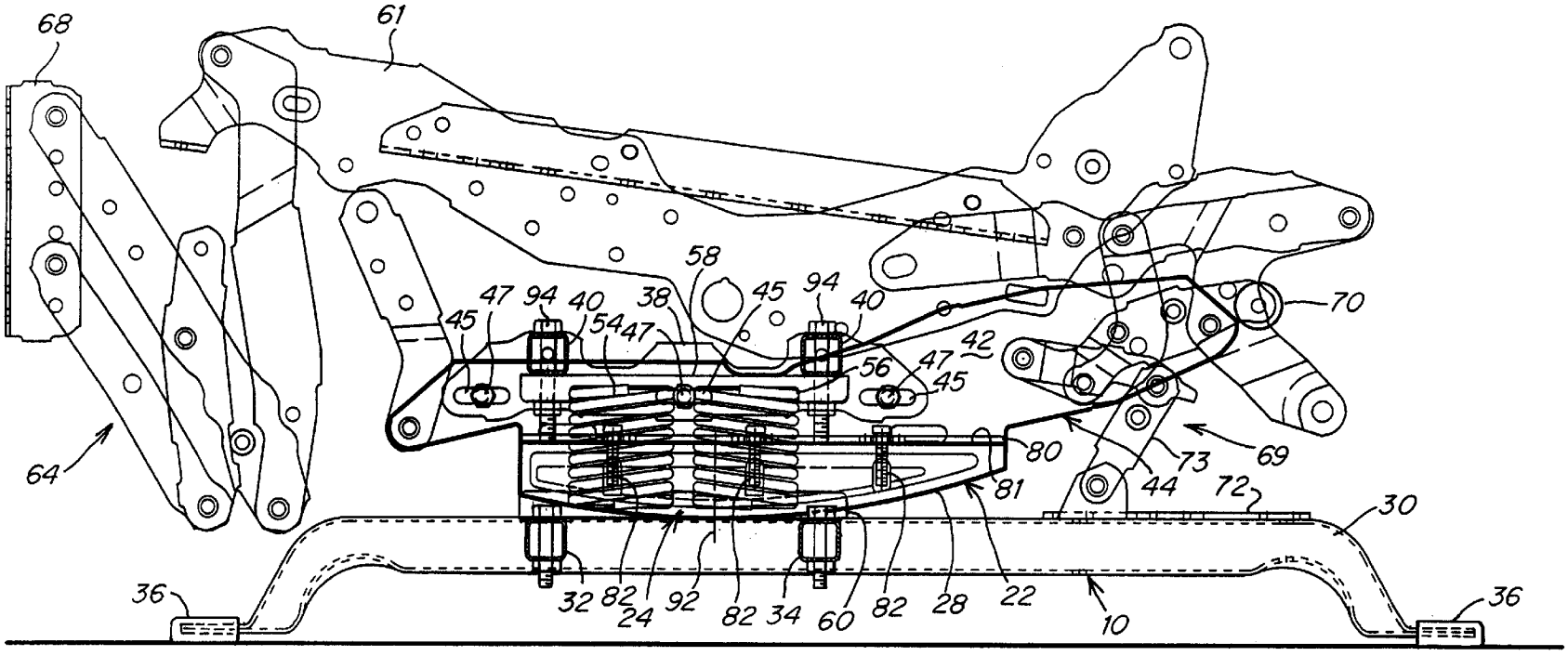
FIG. 2A is a view similar to FIG. 2 but showing more of the reclining mechanism and with a cam and base plate of the mechanism highlighted.

It will be appreciated that because of the adjustable connections between the cams 22 and mechanism 18 and between the spring assemblies 24 (via the cross tube assembly) and the mechanism, it is relative easy to compensate for chair styles having different weight distributions (heavy or light backs and deep or short seats) and different centers of gravity. The spring assemblies may be moved forward or back to compensate for different weight distributions while the cams may be moved forward or back to maintain the cam center line in close alignment with the center of gravity for a balanced rocking action. During the adjustments the individual rocker springs 54 and 56 remain securely fastened to the upper cross tube assembly 20 and lower cross rails 32 and 34 forming part of the lower base assembly. Therefore, adjustments in the location of the spring assemblies may be made without disconnecting the preloaded springs. It will be noted in FIGS. 2 and 2A that long bolts 94 are used to connect the upper plates 58 of the spring assemblies 24 to the cross tubes 40. This arrangement enables the spring to be easily installed without special spring spreader tools, which reduces assembly time.

The embodiment of the invention shown in FIGS. 8–11 is very similar to the preferred embodiment of FIGS. 1–7. The two differ from one another in the construction of the base and the attachment of the spring assembly to the base. In this embodiment, the base 100 is made of two wood side rails 102 connected together by wood cross rails 104. The rocker cams 106, like the cams 22 in the preferred embodiment, may be made of wood, plastic or metal, although plastic is suggested in the drawings of the preferred embodiment and wood is suggested in this embodiment. The side rails 102 have feet 108 at their bottom ends to protect the floor on which the chair rests and may also be used to level the base when the floor is uneven.

Each spring assembly 110 is composed of tensioned coil springs 112, a top plate 114 and a bottom bracket 116. Just as in the preferred embodiment, the top plates 114 are attached to the cross tubes 40 of the cross tube assembly 20 by long bolts 94, and the cross tube assembly 20 is adjustably bolted to the base plates 44 of the reclining mechanism 18 through horizontal slots 120 in the end plates 122 of the cross tube assembly.

The vertical flange 117 of the bottom bracket 116 of each spring assembly 110 is screwed to the inner vertical surface 124 of the corresponding side rail 102 on its side of the chair. The horizontal flange 115 of the bracket 116 anchors the bottoms of the springs.

Each base plate 44 of the reclining mechanism, just as in the preferred embodiment, has a lower horizontal flange 80 that is adjustably mounted on the horizontal upper surface 130 of one of the rocker cams 106. While not shown in the drawings, the adjustment may be accommodated by multiple openings in the flange 80 or by some other means. If the rocker cams are made of wood, the flanges 80 may simply be attached by screws that may be positioned at any location on the surface 130.

In the embodiment of FIGS. 8–11, the reclining mechanism 18, chair frame 26 seat 12, back 14 and leg rest 16 are essentially the same as those of the preferred embodiment and are correspondingly numbered.

It will be appreciated from the forgoing that the advantages attributed to the preferred embodiment are also present in the construction of the embodiment of FIGS. 8–11. The spring assemblies 110 may be moved forward and backward simply by moving the cross tube assembly 20 on the base plates 44 of the mechanism independently of the mechanism 18 and the cams 106, and the rocker cams 106 may be adjusted forward and backward independently of the mechanism 18 and spring assemblies 110.

Modifications of the present invention will be apparent to those skilled in the art from a reading of the forgoing description in connection with the accompanying drawings. Therefor, the scope of the invention is not to be limited to the specific embodiments herein shown and described. Rather, its scope is to be determined by the appended claims and their equivalents.

What is claimed is:

1. A rocker-recliner chair comprising:

a base for standing on a floor and having a pair of side rails, rocker cams seated for rocking motion backward and forward on the side rails, a cross tube assembly disposed above the base and having side plates and cross tubes, a reclining linkage mechanism having a pair of base plates adjustably connected to the cams for backward and forward adjustment with respect to the cams, adjustable connections joining the cross tube assembly to each base plate of the mechanism for enabling the cross tube assembly to be moved forward and backward with respect to the mechanism, a chair frame having a seat, backrest and footrest carried by the mechanism and movable between upright and reclined positions with respect to the base, and a stabilizing spring assembly connected between the cross tube assembly and the base for biasing the rocker cams, linkage mechanism and chair frame to an upright position on the base.

2. A rocker-recliner chair according to claim 1 wherein a rocker blocker assembly is carried by the mechanism for preventing the cams from rocking on the side rails when the chair moves from the upright position.

3. A rocker-recliner chair comprising:

a base having a pair of side rails, a pair of rocker cams, one on each of the side rails for rocking motion back and forth on said rails, a reclining chair mechanism mounted on and carried by the rocker cams, a cross tube assembly mounted above the base and connected to the mechanism, a chair frame with a seat and backrest mounted on the mechanism enabling the chair frame to move between upright and reclined positions, a spring assembly connected between the cross tube assembly and the base for biasing the cams and chair frame to the upright position, and a rocker blocker for preventing the cams from rocking on the base when the chair frame moves from the upright position.

4. A rocker-recliner chair according to claim 3 wherein an adjustable connection joins the cams to the mechanism enabling the cams to be moved forward or backward on the side rails independently of the spring assembly.

5. A rocker-recliner chair according to claim 4 wherein an adjustable connection joins the cross tube assembly to the mechanism enabling the spring assembly to be moved forward and aft with respect to the rocker cams independently of the connection between the mechanism and cams.

6. A rocker-recliner chair according to claim 3 wherein an adjustable connection joins the cross tube assembly to the mechanism enabling the spring assembly to be moved forward and aft with respect to the rocker cams independently of the connection between the mechanism and cams.

7. A rocker assembly for rocker recliners comprising:

a base, a rocker cam mounted for rocking motion on the base backward and forward from a neutral position, a reclining mechanism mounted on the rocker cam, a cross tube assembly adjustably mounted on the mechanism for backward and forward adjustment with respect thereto, and a spring assembly connected between the cross tube assembly and the base and adjustable backward and forward with respect to neutral position of the cam by virtue of the adjustability of the cross tube assembly on the mechanism.

8. A rocker assembly as defined in claim 7 wherein the cam is adjustably connected to the mechanism so that it may be moved backward and forward with respect thereto independent of the connection of the spring assembly to the mechanism.

9. A rocker assembly as defined in claim 7 wherein the base is made of wood.

10. A rocker assembly as defined in claim 9 where the cam is made of plastic.

11. A rocker assembly as defined in claim 9 wherein the cam is made of wood.

12. A rocker assembly as defined in claim 7 wherein the base is made of metal.

13. A rocker assembly as defined in claim 12 wherein the cam is made of wood.

14. A rocker assembly as defined in claim 12 where the cam is made of plastic.

15. A rocker assembly for rocker recliners comprising:

a base, a rocker cam mounted for rocking motion on the base backward and forward from a neutral position, a reclining mechanism mounted on the rocker cam, a cross tube assembly mounted on the mechanism independently of the cam, a spring assembly connected between the base and the cross tube assembly, and an adjustable connection between the mechanism and the cam enabling the cam to be moved backward and forward with respect to the mechanism independently of the connection of the cross tube assembly to the mechanism.

* * * * *